US010781670B1

(12) United States Patent
Cargol, Jr. et al.

(10) Patent No.: US 10,781,670 B1
(45) Date of Patent: Sep. 22, 2020

(54) PROCESS FOR NON-VERTICAL INSTALLATION AND REMOVAL OF A SUBSEA STRUCTURE

(71) Applicant: TRENDSETTER ENGINEERING, INC., Houston, TX (US)

(72) Inventors: Patrick Michael Cargol, Jr., Houston, TX (US); Brett Morry, Houston, TX (US); Weili Guo, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

(21) Appl. No.: 16/598,662

(22) Filed: Oct. 10, 2019

(51) Int. Cl.

| | |
|---|---|
| ***E21B 33/035*** | (2006.01) |
| ***E21B 41/00*** | (2006.01) |
| ***E21B 41/04*** | (2006.01) |
| ***E21B 43/01*** | (2006.01) |
| ***B63B 35/00*** | (2020.01) |
| ***B63B 35/28*** | (2006.01) |
| ***B63G 8/00*** | (2006.01) |

(52) U.S. Cl.
CPC ..... *E21B 43/0122* (2013.01); *B63B 35/003* (2013.01); *B63B 35/28* (2013.01); *B63G 8/001* (2013.01); *E21B 33/035* (2013.01); *E21B 41/0007* (2013.01); *E21B 41/04* (2013.01); *B63G 2008/005* (2013.01)

(58) Field of Classification Search
CPC .... E21B 33/035; E21B 41/0007; E21B 41/04; E21B 43/0122; B63B 35/003; B63B 35/28; B63G 8/001
See application file for complete search history.

(56) References Cited

U.S. PATENT DOCUMENTS

| | | | | |
|---|---|---|---|---|
| 4,324,505 | A * | 4/1982 | Hammett | E21B 19/002 405/60 |
| 4,358,218 | A * | 11/1982 | Graham | E21B 43/0122 210/922 |
| 4,797,035 | A * | 1/1989 | Hunter | E21B 43/017 405/205 |
| 7,882,794 | B2 * | 2/2011 | Baylot | B63B 27/08 114/312 |
| 8,430,171 | B2 * | 4/2013 | Cochrane | E21B 43/0122 166/356 |
| 8,720,580 | B1 | 5/2014 | Lugo | |
| 8,826,989 | B2 * | 9/2014 | Lyle | E21B 43/0122 166/363 |

(Continued)

*Primary Examiner* — Matthew R Buck
(74) *Attorney, Agent, or Firm* — Egbert, McDaniel & Swartz, PLLC

(57) ABSTRACT

A process for installing or removing a subsea structure in a non-vertical manner at a well includes securing a plurality of barges together in a linear formation in which one of the plurality of barges has a downline extending therefrom, connecting an end of the barges to a primary vessel, moving the primary vessel such that one of the barges is positioned over a target at or adjacent to the well, connecting a plurality of secondary vessels by plurality of mooring lines to an opposite end of the barges, tensioning the mooring line so as to fix the opposite end of the barges, positioning a deployment vessel away from the barges, deploying an ROV, manipulating the ROV so as to connect the subsea structure to the downline, and moving the downline and the subsea structure toward or away from the well.

19 Claims, 8 Drawing Sheets

(56) References Cited

U.S. PATENT DOCUMENTS

| | | | | |
|---|---|---|---|---|
| 8,992,127 | B2 * | 3/2015 | Joensen | B63B 27/00 405/205 |
| 9,033,051 | B1 | 5/2015 | Lugo | |
| 9,038,728 | B1 | 6/2015 | Lugo | |
| 9,080,393 | B2 * | 7/2015 | Wishahy | E21B 17/01 |
| 9,080,411 | B1 | 7/2015 | Lugo | |
| 9,316,081 | B2 * | 4/2016 | Hanna | E21B 43/0122 |
| 9,340,942 | B2 * | 5/2016 | Luppi | E21B 43/0122 |
| 2011/0206465 | A1 * | 8/2011 | Howard | B63B 35/42 405/205 |
| 2011/0274496 | A1 * | 11/2011 | Dvorak | E21B 43/0122 405/64 |
| 2016/0059944 | A1 * | 3/2016 | Foster | E21B 41/0007 114/331 |
| 2016/0060993 | A1 * | 3/2016 | Foster | E21B 41/0007 405/205 |
| 2017/0350210 | A1 | 12/2017 | Lugo | |

* cited by examiner

PROCESS FOR NON-VERTICAL INSTALLATION AND REMOVAL OF A SUBSEA STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the installation and removal of subsea structures. More particularly, the present invention relates to the non-vertical installation and removal of structure on wellheads and/or blowout preventers. More particularly, the present invention relates to the installation and removal of such items when vertical access is restricted.

2. Description of Related Art Including Information Disclosed Under 37 CFR 1.97 and 37 CFR 1.98

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

One of the problems associated with diverter systems for such blowout preventers is that, under certain circumstances, the pressure of the fluid released from the blowout preventer is of extremely high pressures, up to 15,000 p.s.i. Under such circumstances, if there is a release from the blowout preventer, or from the wellhead, these extreme pressure will cause boiling and turbulence in the water directly above the blowout preventer and/or wellhead. This boiling of hydrocarbons in the water directly adjacent to the oil platform is extremely hazardous. First, the amount of turbulence caused by such boiling makes it extremely difficult to carry out further repair activities. Under other circumstances, the presence of such hydrocarbons on the top of the water will create an extreme fire and explosion hazard. As such, it is extremely important so as to avoid the release of hydrocarbons from the subsea well such that the boiling action of the released hydrocarbons is diverted away from the offshore platform or from marine vessels associated therewith.

In the event of a subsea blowout in shallow water, where vertical access to the well is not available due to environmental conditions on the surface, it is important to be able to remove subsea debris or deploy subsea equipment, while maintaining separation of the surface boil from personnel involved in the response. As such, it is important to be able to allow operators to gain vertical access to shallow water high-rate gas well blowouts while keeping personnel out of harms way.

Gas making its way to the surface makes station keeping in the surface boil impossible. Vessels need to be positioned outside the perimeter of the plume. Gas expression on the surface makes the local environment hazardous for personnel. To mitigate this problem, personnel need to maintain separation upwind from the boil.

Additionally, the plume created from the subsea blowout can make movement of the payload toward the subsea structure difficult. As such, it is important to be able to adapt the lowering of equipment to rough seas states and/or gas boiling conditions. It is also necessary to improve the accuracy of moving the payload toward the subsea structure in order to properly install the payload on to the subsea structure.

Under certain circumstances, the blowout can be contained through the use of a capping stack. The capping stack is the subject of various patents by the present Applicant. For example, U.S. Pat. No. 9,080,411, issued on Jul. 14, 2015 to the present Applicant, describes a subsea diverter system for use with a blowout preventer. This apparatus diverts fluid from a subsea well. A diverter is affixed between the upper and lower portions of the blowout preventer. Each of the upper portion and lower portion of the blowout preventer has a flow passageway extending vertically therethrough. The diverter has an interior passageway extending vertically therethrough in alignment with the flow passageway of the upper and lower portions of the blowout preventer. The diverter has a flowline communicating with the interior passageway and extends outwardly therefrom. The flowline has a valve thereon which is movable between an open position and a closed position. The open position is suitable for allowing at least a portion of the fluid from the flow passageway to pass outwardly of the flowline to a location remote from the blowout preventer.

U.S. Pat. No. 9,038,728, issued on May 26, 2015 to the present Applicant, describes a system and method for diverting fluids from a wellhead by using a modified horizontal Christmas tree. The system has a capping stack with a connector suitable for connection or interconnection to the wellhead, a flow base fixedly positioned in the subsea environment, and a conduit connected to the outlet of a diverter line of the capping stack and connected to the inlet of an interior passageway of the flow base. The conduit is suitable for passing fluids from the capping stack toward the flow base. The flow base is a modified horizontal Christmas tree.

U.S. Pat. No. 8,720,580, issued on May 13, 2014 to the present Applicant, also describes a system and method for diverting fluids from a damaged blowout preventer. The system has a capping stack with a connector suitable for connection to the blowout preventer, a flowing stack, and an intervention blowout preventer connected to the connector of the flowing stack. The capping stack as a fluid passage extending from the connector. The capping stack has at least one diverter line in communication with the fluid passage. The flowing stack has an interior passageway extending to the connector at an upper end thereof. The flowing stack has at least one pipe in communication with the interior passageway. The pipe is connected with the diverter line of the capping stack such that a flow fluid passing through the diverter line passes through the pipe into the interior passageway of the flowing stack.

U.S. Pat. No. 9,033,051, issued on May 19, 2015, teaches a system for diversion of fluid flow from a wellhead. The system has a mudline closure mechanism suitable for attachment to the wellhead, a blowout preventer connected or interconnected to the mudline control mechanism, and a flow control line having one end connected to a diversion passageway of the mudline control mechanism and extending therefrom such that an opposite end of the flow control line is disposed away from the mudline closure mechanism. The mudline closure mechanism has a main passageway communicating with the flow passageway of the blowout preventer. The mudline closure mechanism has a valve suitable for switching fluid flow from the main passageway to the diversion passageway. The blowout preventer is positioned above the mudline closure mechanism. The flow control line is supported by a base anchored to the subsea floor away from the mudline closure mechanism.

U.S. Patent Application Publication No. 2017/0350210, published on Dec. 7, 2017 to the present Applicant, teaches a rapid mobilization air-freightable capping stack system. This is a method and apparatus for transporting a capping stack for use in a subsea structure. This apparatus includes a capping stack having a capping stack spool, a connector body connected to the capping stack spool and at least one diverter leg connectable to the capping stack spool. A first skid receives the capping stack spool on the floor thereof. The second skid receives the connector body on a floor thereof. A third skid receives the diverter leg thereon. The first, second and third skids are adapted to be received within an interior of an aircraft. The skids and the connected components can then be flown by the aircraft to a desired location so as to be assembled at a location near a wellhead.

Of course, one difficulty associated with any attempt to install the capping stacks of the present Applicant is when the well is blowing so as to create a large plume from the wellhead up to the surface of the water. Since the gases associated with the plume are extremely explosive and toxic, it is important to be able to install the capping stack without placing personnel in a hazardous position in relation to the plume. As such, it is necessary for all personnel associated with the installation of the capping stack to reside outside the plume. Unfortunately, the blowing well is usually at the center of the plume. As such, there has been a difficulty in installing the capping stack while, at the same time, maintaining personnel away from the plume.

Under certain circumstances, vertical access to the well and/or blowout preventer is restricted by objects or conditions that restrict vertical access. For example, a rig can be located in a position above the well. As such, direct vertical access to the well is restricted by the position of the rig on the surface of the water. As such, a need has developed whereby access to the subsea structure can be obtained in a non-vertical manner.

It is object of the present invention to provide a system for installing and removing a subsea structure in which access to the subsea structures obtained in a non-vertical manner.

It is another object the present invention to provide a system for installing and removing a subsea structure which maintains personnel a safe distance away from a plume associated with the well.

It is another object the present invention to provide a system which avoids potential explosions and fires during the process of installing and removing the subsea structure.

It is another object of the present invention provide a system that improves the health and safety of workers associated with the installation and removal of the subsea structures.

It is another object of the present invention to provide a system for installing and removing subsea structure which avoids the use of divers and other underwater personnel.

It is still a further object of the present invention to provide a system that quickly and efficiently closes a blowing well.

It is still further object of the present invention provide a system that utilizes conventional and readily available equipment for the installation or removal of subsea structures.

It is still a further object of the present invention to provide a system that absorbs the motion of rough sea states and/or gas boiling conditions.

It is still a further object of the present invention to provide a system that allows for relatively accurate and rapid placement of the payload onto the subsea structure.

These and other objects and advantages of the present invention will become apparent from a reading of the attached specification and appended claims.

BRIEF SUMMARY OF THE INVENTION

The present invention is a process for installing or removing a subsea structure in a non-vertical manner to or from a wellhead located at the sea floor. The process includes the steps of: (1) securing a plurality of barges together in a linear formation in which one of the plurality of barges has a downline extending therefrom; (2) connecting one end of the plurality of barges to a primary vessel; (3) moving the primary vessel such that at least one of the plurality of barges is positioned vertically over a target at or adjacent to the well; (4) connecting a plurality of secondary vessels by a plurality of mooring lines adjacent an opposite end of the plurality of barges; (5) tensioning the plurality of mooring lines so as to fix a position of the opposite end of the plurality of barges over the target; (6) positioning a deployment vessel away from the plurality of barges; (7) deploying an ROV from the deployment vessel; (8) manipulating the ROV so as to connect the subsea structure to the downline; and (9) moving the downline and the subsea structure toward or away from the well.

In the preferred embodiment of the present invention, the well is a blowing well. The blowing well forms a plume and the water surface. The step of moving the primary vessel includes moving the primary vessel such that at least one of the plurality of barges is positioned within the plume. The target is the wellhead of the blowing well or a blowout preventer or lower marine riser package (LMRP) at the blowing well. The process further includes lowering the subsea structure from the deployment vessel toward the target and moving the subsea structure with the ROV toward the downline. The step of moving the downline includes moving the downline of the subsea structure toward the target and affixing the subsea structure to the wellhead, to the blowout preventer or to the LMRP at the wellhead.

In an alternative embodiment of the present invention, the process is for the removal of the subsea structure. The subsea structure is positioned adjacent to the wellhead. The process includes deploying the ROV from the deployment vessel such that the ROV moves downwardly toward the subsea structure, affixing the downline to the subsea structure, and raising the subsea structure by paying in the downline from the plurality of barges.

In the process of the present invention, a gas detection device is installed on the plurality of barges and the deployment vessel. Gas conditions are sensed by the gas detection device at the plurality of barges and the deployment vessel.

The step of tensioning includes moving the plurality of secondary vessels so as to triangulate the opposite end of the plurality of barges within the primary vessel and the plurality of secondary vessels. In particular, the plurality of second vessels can comprise a pair of secondary vessels that extend at an approximately 120° angle relative to linear formation of the plurality of barges.

In the preferred embodiment of the present invention, the subsea structure is a capping stack. The step of affixing the subsea structure comprises affixing the capping stack to the blowout preventer.

The primary vessel and the plurality of secondary vessels and the deployment vessel reside outside of the side of the plume throughout the process within the scope of the present invention, the deployment vessel can be one of the primary or secondary vessels. In particular, the primary vessel and the plurality of barges are moved in a direction that is downwind.

Each of the plurality of secondary vessels has a winch thereon. The winch is actuated so as to pay in the mooring lines so that the mooring lines are tensioned such that an end of the plurality of barges is fixed in position over the wellhead. The plurality of barges includes at least three barges. The primary vessel and the plurality of secondary vessels are moved such that the end of the plurality of barges is located directly above the wellhead.

In the preferred embodiment of the present invention, the subsea structure is moved laterally into the plume with the ROV prior to the step of lowering. The capping stack is positioned over a mandrel of the blowout preventer. The capping stack is lowered onto the blowout preventer. Ultimately, the capping stack is locked on the mandrel of the blowout preventer. The downline can then be released from the capping stack after the capping stack is affixed to the blowout preventer or wellhead.

In the present invention, a shock absorber is attached to the downline from the plurality of barges. The shock absorber has one end connected to the downline from the plurality of barges and an opposite end of the shock absorber is connected to the subsea structure. Variations in sea conditions caused by rough sea states and/or gas boiling conditions are accommodated by the shock absorber. The shock absorber minimizes increase dynamic loads and motion from the environment. The shock absorber comprises a housing having a piston-and-cylinder arrangement therein. The shock absorber is a passive heave compensator which is a spring-damper system based on a gas (e.g. nitrogen) pressure and hydraulic fluid. The passive heave compensator is generally connected between the crane/winch hook and the payload in order to reduce the dynamic load on the hoisting system, the payload and the crane tip.

In the present invention, in order to provide accuracy toward the placement of the subsea structure under the blowout preventer or wellhead, a pair of winches are deployed in the subsea environment. The subsea winches are connected to the subsea structure and to an adapter spool affixed to the wellhead or blowout preventer. The lines extending from the subsea wenches are joined to slings connected to the subsea structure. The wenches will draw the subsea structure toward the mandrel of the blowout preventer by moving along sheaves placed on the adapter spool. Ultimately, the connector of the subsea structure can continue to be drawn by the slings and lines toward the mandrel so as to land properly upon the mandrel.

The present invention is also a process for installing a capping stack onto a wellhead or a blowout preventer. This process includes the steps of: (1) securing a plurality of barges together in a linear formation in which one of the plurality of barges has a downline extending therefrom; (2) connecting one end of the plurality of barges to a primary vessel; (3) moving the primary vessel such that at least one of the plurality of barges is positioned within the plume; (4) connecting a plurality of secondary vessels by a plurality of mooring lines adjacent to an opposite end of the plurality of barges; (5) tensioning the plurality of mooring lines so as to fix a position of the opposite end of the plurality of barges generally above the wellhead; (6) positioning a deployment vessel away from the plurality of barges and away from the periphery of the plume; (7) lowering the subsea structure from the deployment vessel downwardly toward a seabed; (8) moving the subsea structure with the ROV toward the downline of the barge; (9) connecting the subsea structure to the downline; (10) moving the downline of the subsea structure toward the blowing well; and (11) affixing the subsea structure to the wellhead or the blowout preventer at the wellhead.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
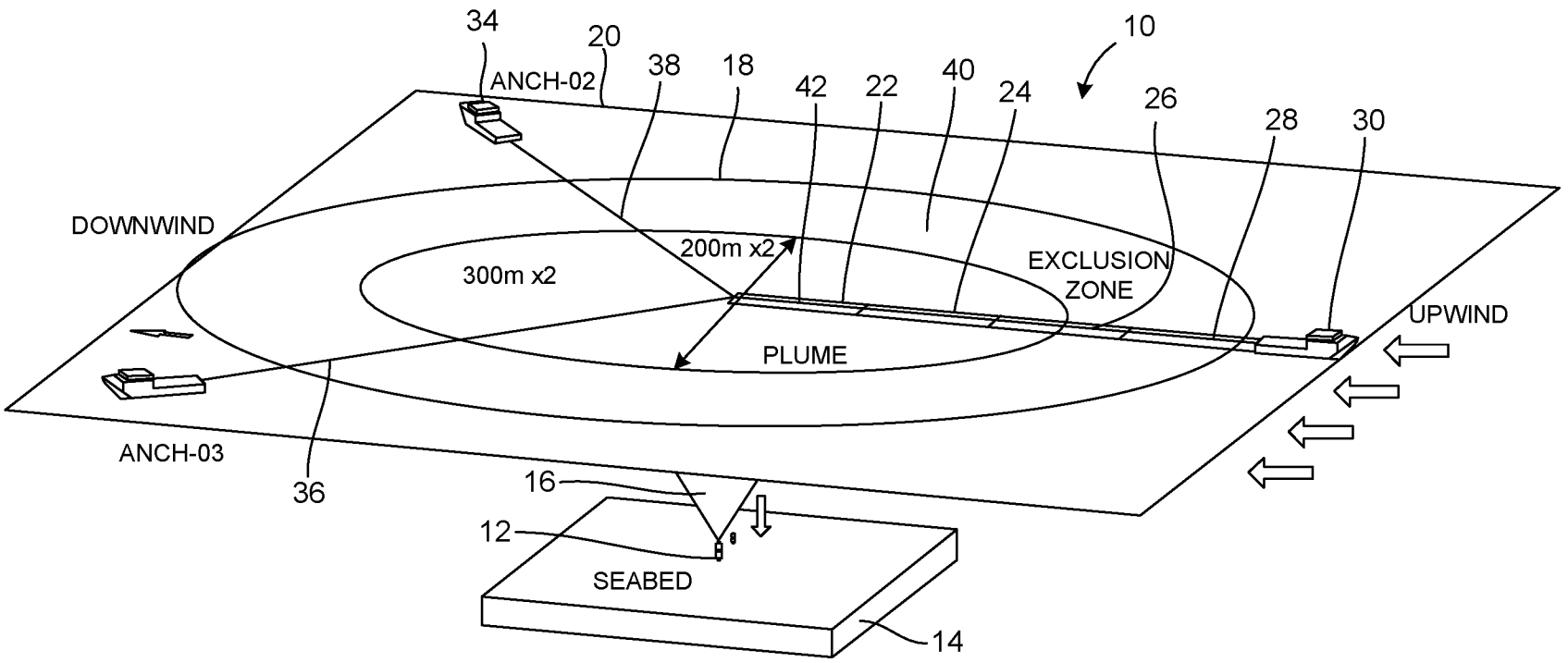
FIG. 1 is a diagrammatic illustration of the system of the present invention.

FIG. 1 shows the system 10 of the present invention as employed in association with a blowing well 12 located on seabed 14. It can be seen that the blowing well 12 emits a plume 16 of hydrocarbons that will flow in a conical shaped manner toward the surface 18 of the body of water 20. Typically, the blowing well 12 can either be blowing at the wellhead itself or outwardly of a blowout preventer.

Importantly, the present invention can also be used so as to install or remove a subsea structure and a non-vertical manner. In certain circumstances, there may be no plume that is released from a blowing well. Within the concept of the present invention, there can be obstacles to the vertical deployment or removal of the subsea structure. These obstacles can be items such as a rig or other structure affixed within the body of water above the wellhead. As such, access to the well, under those circumstances of a blowing well or under those circumstances of obstacles, needs to be carried out in a non-vertical manner. The present invention is intended to provide access for the installation or removal of a subsea structure from a location laterally offset from the wellhead.

FIG. 1 shows that there is a plurality of barges 22, 24, 26 and 28 that are connected in end-to-end relationship so as to have a linear formation. A primary vessel 30 is connected to the barge 28. Primary vessel 30 is in the nature of a tugboat and is configured so as to properly move the barges 22, 24, 26 and 28 into a desired position within the plume 16. There is a pair of secondary vessels 32 and 34 that are connected by mooring lines 36 and 38 to the end of the barge 22. Winches will be located on the secondary vessels 32 and 34 so as to create tension in the respective mooring lines 36 and 38. Once tension is created in the mooring lines 36 and 38, the plurality of barges 22, 24, 26 and 28 can be maneuvered to a desired position within the exclusion zone 40 of the plume 16. The secondary vessels 32 and 34 will extend at a 120° angle with respect to the linear formation of barges 22, 24, 26 and 28 so as to triangulate the end 42 of the plurality of barges within the primary vessel 30 and the pair of secondary vessels 32 and 34. The pair of secondary vessels 32 and 34 will extend to an approximately 120° angle with respect to the plurality of barges 22, 24, 26 and 28. As such, the end 42 of barge 22 will be positioned generally directly above the wellhead 12.

The barge 22 will have a downline 64 (see FIG. 4) extending downwardly from the end 42. Downline 64, along with an associated hoisting and lowering mechanism, will facilitate the ability to install or remove the capping stack on or from the blowing well 12.

In FIG. 1, it can be seen that the primary vessel 30 and the secondary vessels 32 and 34 are positioned outside of the exclusion zone 40 of the plume 16. As such, the personnel onboard these vessels 30, 32 and 34 will be away from the danger zone. The primary vessel 30 is illustrated as being upwind of the plume 16. The secondary vessels 32 and 34 are illustrated as being downwind of the plume 16. So as to avoid potential toxic effects to personnel aboard vessels 30, 32 and 34, the vessels will be equipped with gas detection equipment and water curtains. The barges are also equipped with gas detection devices and water curtains. All of the vessel positioning is performed outside the surface boil location in calm waters. As such, through the use of the barges 22, 24, 26 and 28, in combination with the vessels 30, 32 and 34, the downline and hoisting equipment associated with the barge 22 can be carried out without the need for personnel ever entering the surface boil area. If the gas detection devices should sense a toxic level of gas in the area, then the vessels can move to a better location or the winches onboard the vessels 32 and 34 can extend the mooring lines further away from the end 42 of the barge 22.

Figure 2:
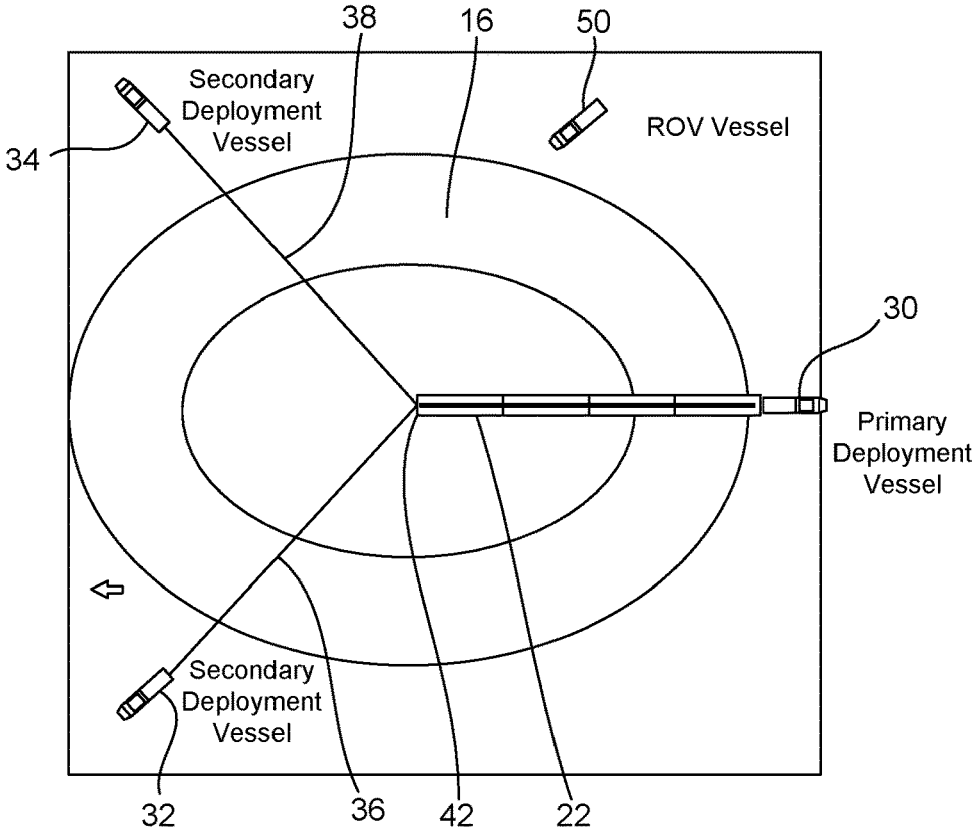
FIG. 2 is a plan view showing the orientation of the various vessels in a final deploying position associated with the system of the present invention.

FIG. 2 is a plan view showing the deployment of the vessels 30, 32 and 34 relative to the plume 16. It can be seen that the barge 22 has its end 42 positioned generally at the center of the plume 16. The mooring lines 36 and 38 extend outwardly from the end 42 of the barge 22 at approximately 120° angle. This angle can be adjusted, as needed, depending on wind or current conditions. Also, if necessary, additional secondary vessels can also be used.

FIG. 2 shows that there is a deployment vessel will also carry the capping stack thereon. The deployment vessel 50 further will have adequate wire capacity and length to handle the capping stack weight. The deployment vessel also has a suitable winch thereon. The deployment vessel 50 will always be outside of the plume 16. The deployment can be a separate vessel or one of the primary and secondary vessels.

Figure 3:
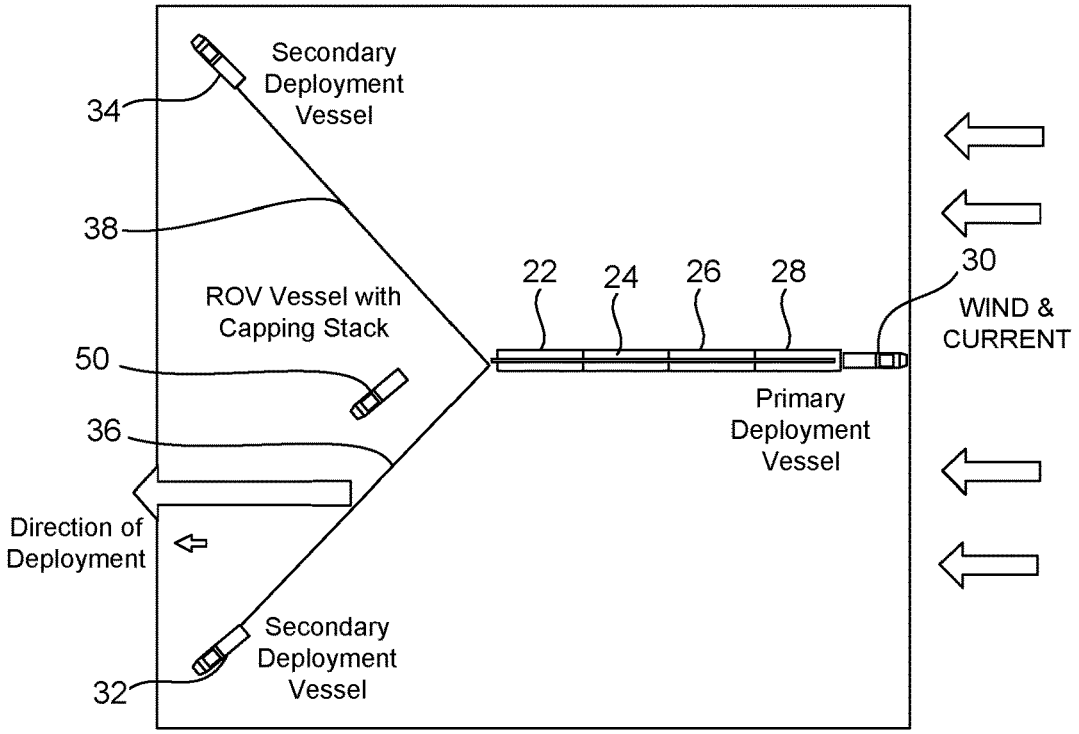
FIG. 3 is a plan view showing an initial manner of deploying the system of the present invention.

FIG. 3 illustrates the deployment of the system 10 of the present invention in a calm water surface outside the blowout plume area. In particular, the primary vessel 30 will move with the direction of the wind and current. The barges 22, 24, 26 and 28 are secured to the primary vessel 30 in end-to-end relationship. As such, the primary vessel 30 will move the joined barges 22, 24, 26 and 28 in the manner of conventional barge movement. The deployment vessel 50 will travel in the direction of the wind and current to the deployment location. The deployment vessel 50 can include an overboarding chute to assist in recovery and deployment. The winch onboard the deployment vessel 50 includes sufficient wire to remove/deploy the required payloads at the appropriate depth for the incident well site. The mooring lines 36 and 38 should have a sufficient length in order to allow the secondary vessels 32 and 34 to position the equipment deploying barges in the plume while maintaining station keeping ability of any other vessels with operation personnel onboard outside the plume.

Figure 4:
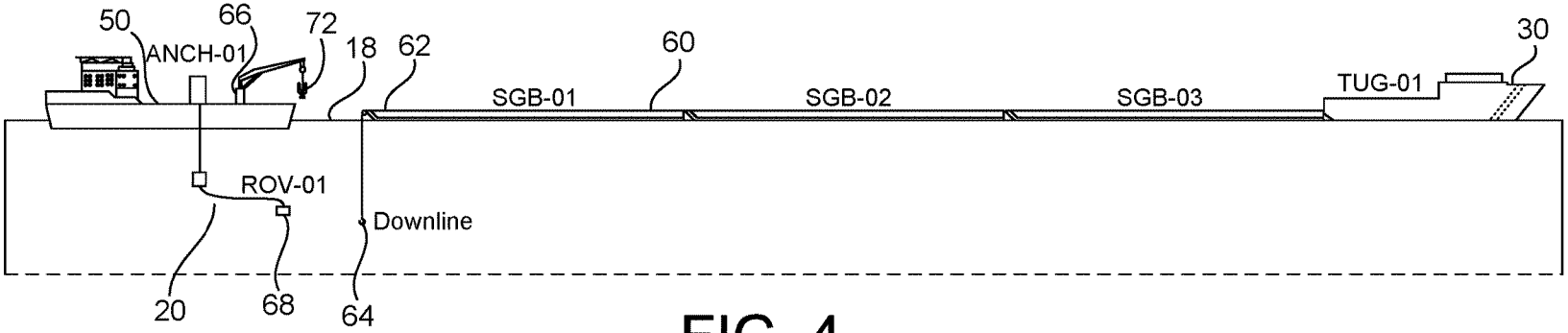
FIG. 4 is a side elevational view showing an initial step in the process of the present invention.

FIG. 4 shows an initial step in the process of the present invention. In FIG. 4, the primary vessel 30 is illustrated as positioned at an end of the plurality of barges 60. The plurality of barges 60 are located at the surface 18 of the body of water 20. The deployment vessel 50 is shown as positioned away from the end 62 of the plurality of barges 60. FIG. 4 shows that there is a downline 64 extending from the end 62 of the plurality of barges 60. The deployment vessel 50 has a crane and winch 66 thereon. Crane and winch 66 has the capping stack 72 connected thereto. An ROV 68 is illustrated as extending downwardly from the deployment vessel 50. The ROV 68 is positioned near the downline 64.

Figure 5:
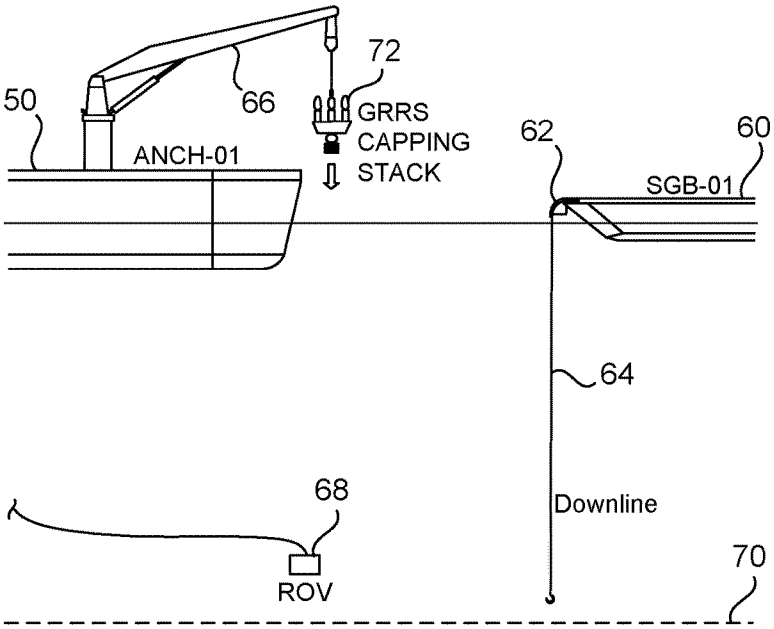
FIG. 5 is a side elevational view showing the following deploying step in the process of the present invention.

FIG. 5 shows the deployment vessel 50 in a position whereby the crane and winch 66 is configured so as to lower the capping stack 72 over the side of the deployment vessel 50. Similarly, the ROV 68 is in a suitable position for acting on the capping stack 72 as it is lowered. The end 62 of the plurality of barges 60 has the downline 64 extending so as to be adjacent to the seabed 70.

Figure 6:
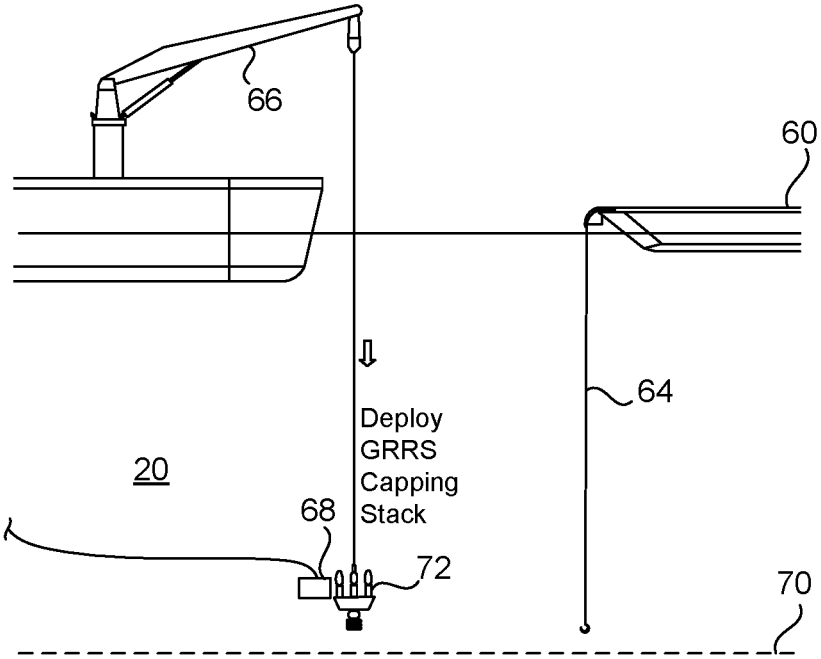
FIG. 6 is a side elevational view showing a further deploying step in the process of the present invention.

FIG. 6 shows a further step in the deployment of the capping stack 72. In particular, the crane and winch 66 lowers the capping stack 72 into the water 20 and toward the seabed 70.

Figure 7:
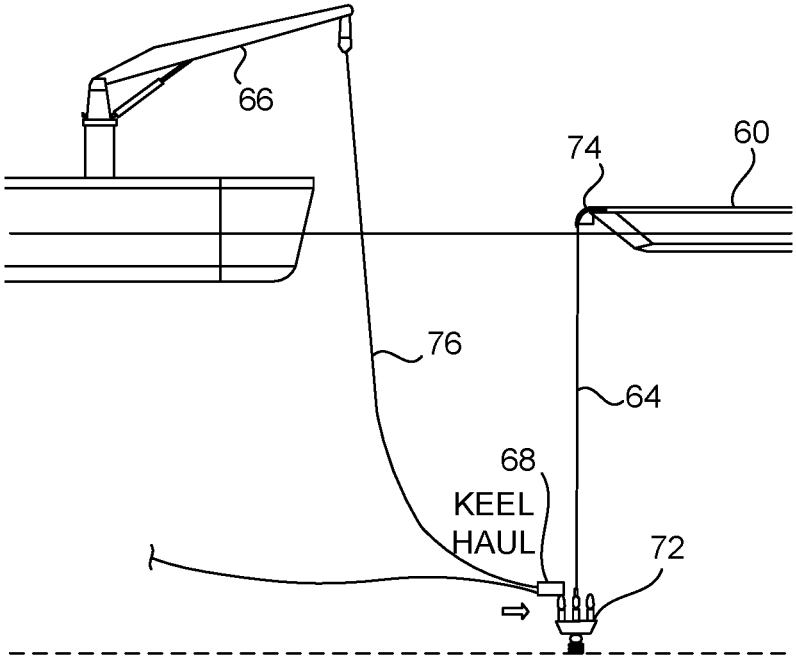
FIG. 7 of the site elevation showing a further deploying step in the process of the present invention.

In FIG. 7, it can be seen that the ROV 68 has grasped the capping stack 72 and has moved the capping stack in a direction toward the downline 64 from the plurality of barges 60. A suitable hoist mechanism 74 on the plurality of barges 60 allows for the remote manipulation of the downline 64. The ROV will secure the downline 64 to the capping stack 72. The line 76 extending from the crane and winch 66 can then be relaxed and released from the capping stack 72.

Figure 8:
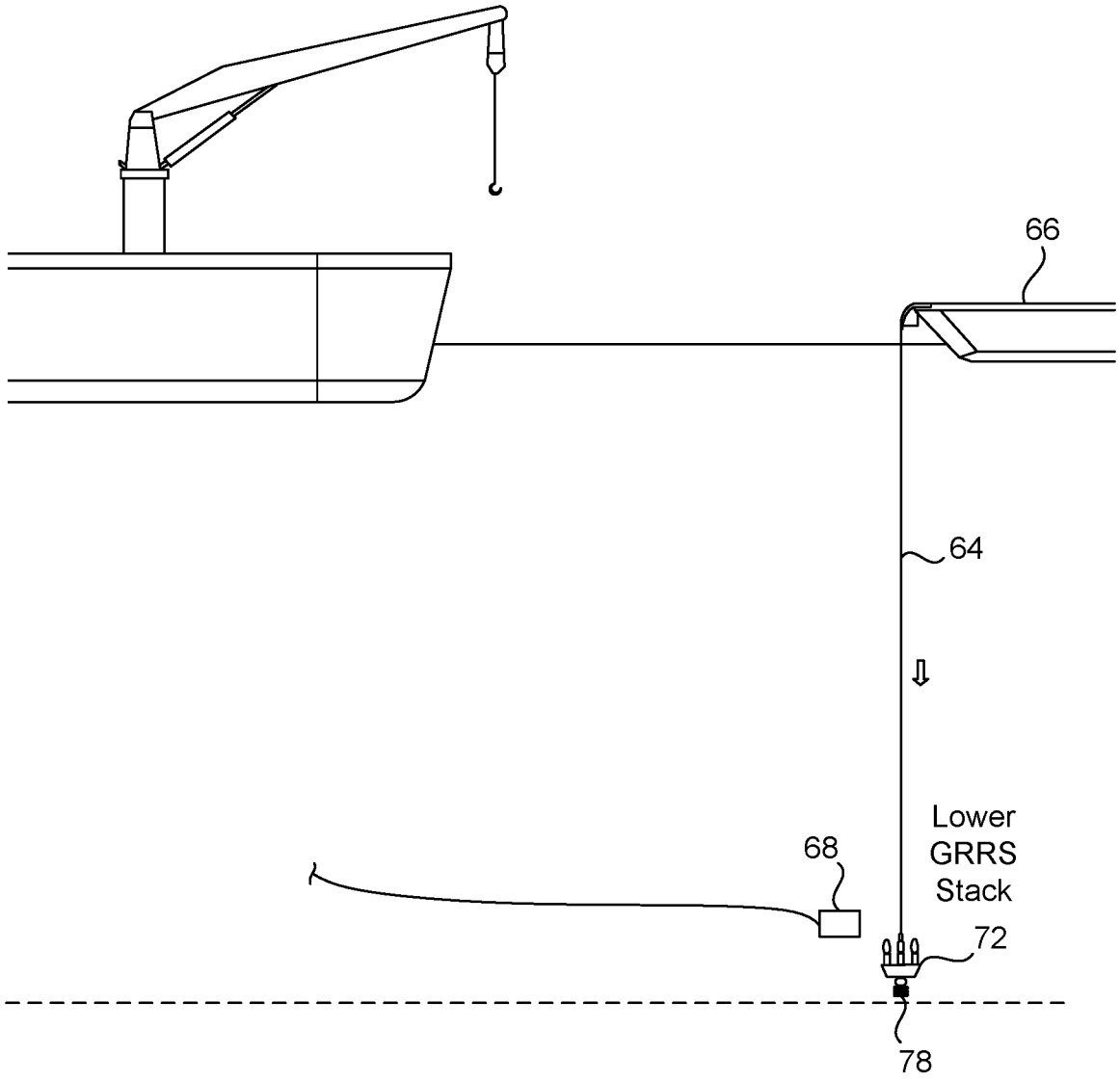
FIG. 8 shows a side elevational view showing the final deploying step of the process of the present invention.

FIG. 8 shows that the ROV 68 moves the capping stack 72 into a desired position over the wellhead 78. The downline 64 can then be lowered from the plurality of barges 60 so that the ROV 68 can manipulate the capping stack 72 so as to be positioned over the mandrel of a blowout preventer or over the wellhead. The downline 64 can then be released from the capping stack 72 and the capping stack 72 can be installed onto the blowout preventer or the wellhead in a conventional manner. The downline 64 can then be returned back to the barge 66.

All of the operations described in FIGS. 4-8 are carried out by personnel outside of the plume. As such, it is not necessary for personnel to be exposed to the hazardous environment at the plume. The barges, which have no personnel thereon, can simply be positioned into the plume so that the necessary operations associated with the downline and the manipulation of the capping stack at the wellhead can be carried out. The ROV can carry out all of the operations associated with the proper movement of the capping stack so that the capping stack can be properly secured to the blowout preventer or the wellhead. After installation, the capping stack can be operated so as to properly control the blowing well or to stop the blowing well.

Figure 9:
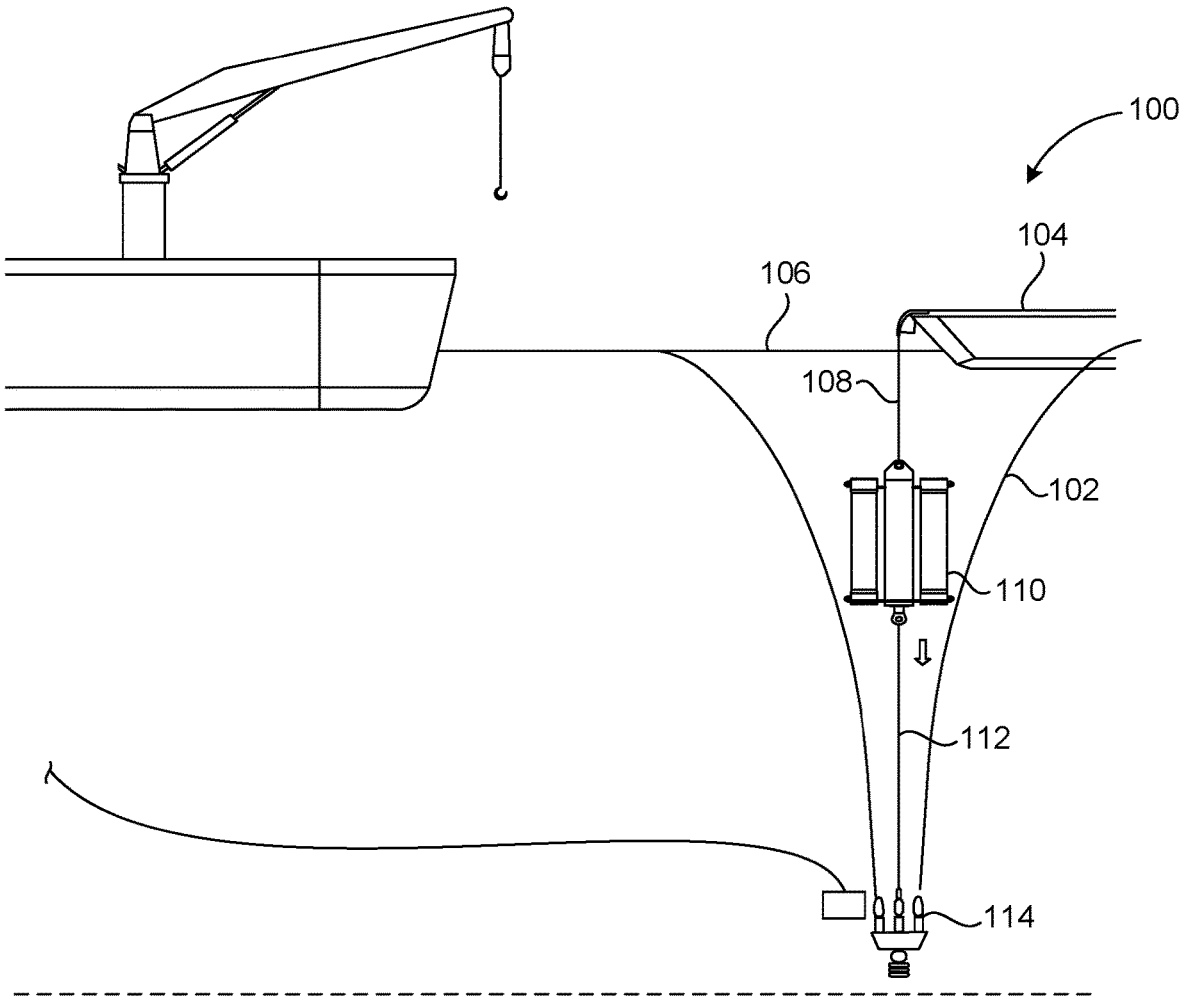
FIG. 9 is a side elevational view showing the process of the present invention involving a passive heave compensator on the downline from the plurality of barges.

FIG. 9 shows the system 100 of the present invention within the gas plume 102. As can be seen, the plurality of barges 104 are located within the plume 102 within the plume at the surface 106 of the sea. The downline 108 extends from the barge at the end of the linear array of barges (as described herein previously). Downline 108 is connected to a shock absorber 110. Another downline 112 extends from the bottom of the shock absorber 110 to the subsea structure 114.

The shock absorber 110 is a passive heave compensator. This is a spring-damper system based on gas pressure and hydraulic fluid. The shock absorber 110 is generally connected between the crane/winch hook and the payload 114 in order to reduce the dynamic load on the hoisting system, the payload and the crane tip. The shock absorber 110 is a standalone system. No external connection of hydraulic/pneumatic hoses or wires are required. This shock absorber 110 is a commercially available unit that by Cranemaster which are certified for subsea lifting operations up to a 3000 meter water depth.

Figure 10:
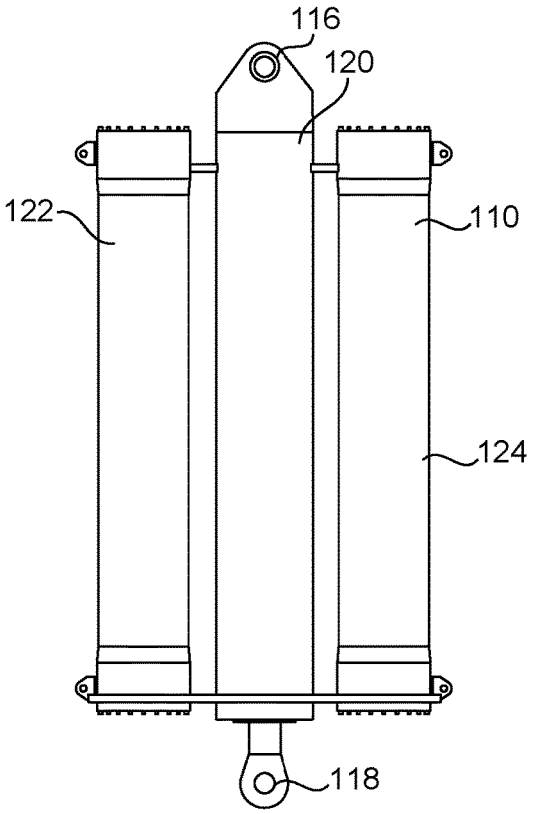
FIG. 10 is an isolated side elevational view of the passive heave compensator of the present invention.
Figure 11:
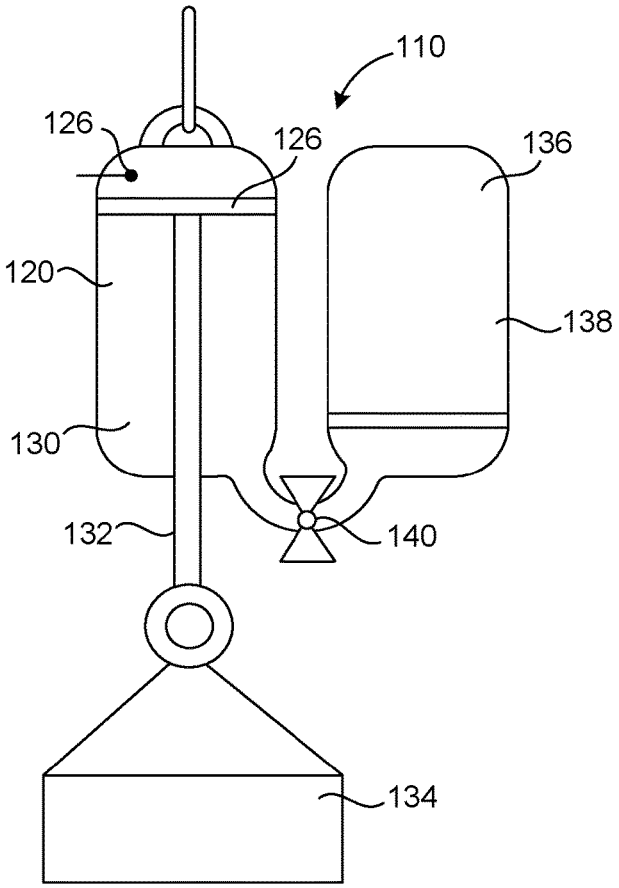
FIG. 11 is a diagrammatic illustration of the internal components of the passive heave compensator of the present invention.

FIG. 10 is an illustration of the shock absorber 110. Shock absorber 110 has a first padeye 116 at the upper end thereof and another padeye 118 at a lower end thereof. Padeye 116 is secured to downline 108. Padeye 118 is secured to the downline 112. Central chamber 120 has a piston-and-cylinder arrangement therein. The side containers 122 and 124 have a gas supplied therein. A nozzle 140 will be positioned between each of the tanks 122 and 124 and the central piston-and-cylinder assembly. FIG. 11 shows the configuration of the shock absorber 110. It can be seen that the central chamber 120 has a cylinder 126 and a piston 128. A vacuum is located within the cylinder 126. Hydraulic fluid 130 is provided on one side of the piston 128. This hydraulic fluid 130 will resist abrupt movements on the piston rod 132 as a result of rough sea conditions affecting the load 134. The gas 136 in the side chamber 138 will further serve to dampen the movements of the load 134. A nozzle 140 is positioned between the gas chamber 138 and the piston-and-cylinder chamber 120.

Figure 12:
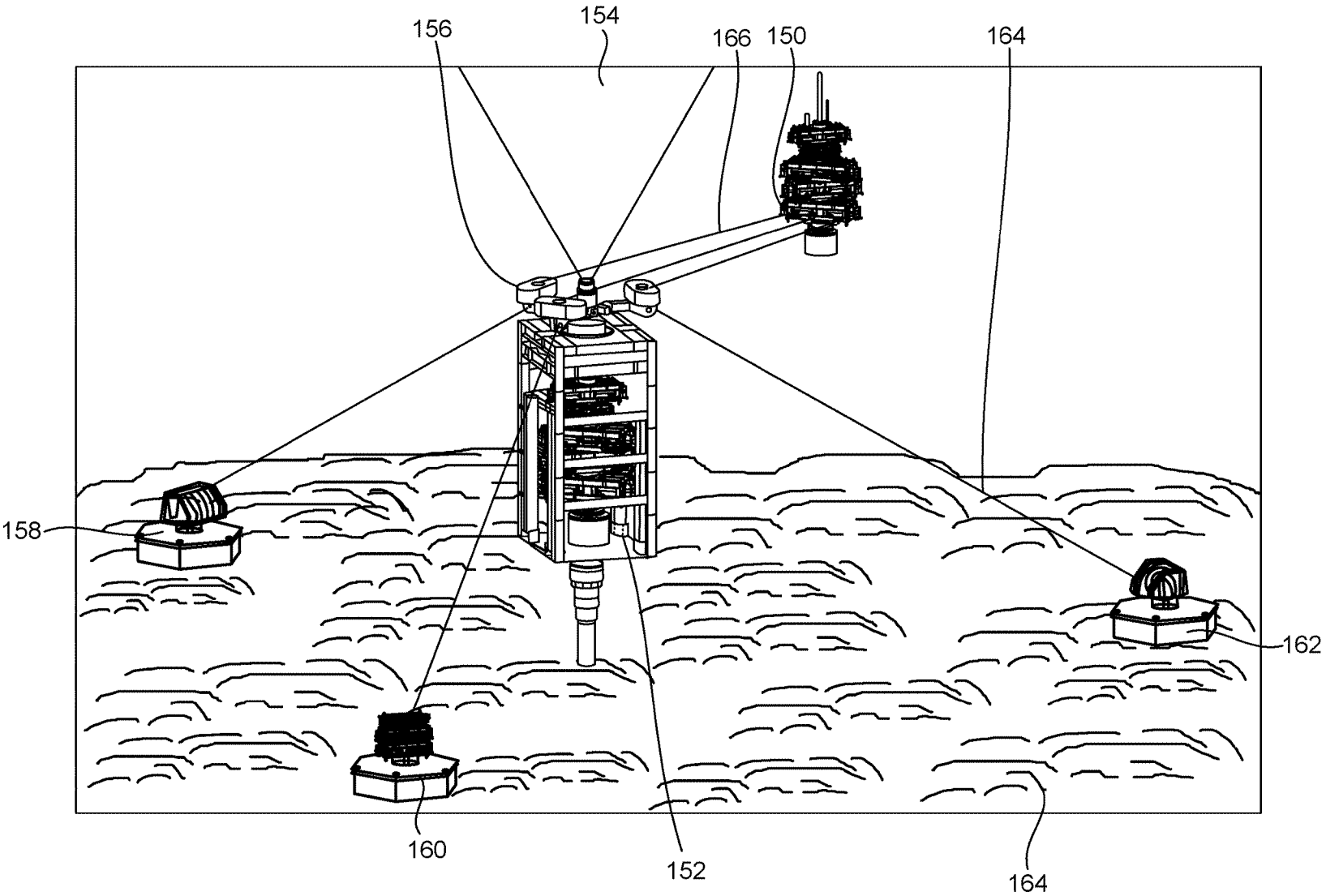
FIG. 12 is a perspective view showing the use of subsea winches for the placement of the subsea structure upon a blowout preventer or a wellhead on the seabed.

Under certain circumstances, it is necessary to accurately move the subsea structure onto the blowout preventer or wellhead. FIG. 12 shows one technique for achieving this accurate movement. As shown in FIG. 12, the ROV has moved the subsea structure 150 into a position adjacent to the blowout preventer 152. The plume 154 prevents a very accurate movement of the subsea structure 150 on to the mandrel of the blowout preventer 152. As such, FIG. 12 shows that there is an adapter spool 156 secured to the mandrel of the blowout preventer 152. The adapter spool 156 has a plurality of sheaves extending outwardly from the bore of the spool. A plurality of winches 158, 160 and 162 are disposed on the seafloor 164. Winches 158, 160 and 162 have respective lines 164 extending therefrom. Lines 164 will engage with slings 166 extending from the subsea structure 150. The winches 158, 160 and 162 are actuated so as to pay in the lines 164 around the sheaves of the adapter spool 156 so as to draw the slings 166 from the subsea structure 150 toward the mandrel of the blowout preventer 152. As such, the system (as described in a co-pending patent application) can achieve a proper placement of the subsea structure 150 on the blowout preventer 152 despite the rough sea conditions caused by the plume 154 and/or the combination of uplift force and disturbing movement caused by the blowout plume. The ROV can move the subsea structure 150 into a position adjacent to the blowout preventer 152. The winches 158, 160 and 162 due the remainder of the work. Ultimately, when the connector of the subsea structure 150 is positioned directly above the mandrel of the blowout preventer 152, the winches 158, 160 and 62 will continue to move so as to move the subsea structure 150 until the connector is engaged with the mandrel of the blowout preventer 152.

With reference to the above figures, the process of the present invention can also be used for the removal of subsea structures at the seabed adjacent to the wellhead. This is also carried out in a non-vertical manner. In this process, the plurality of barges are secured together in a linear formation and one end of the plurality of barges is connected to the primary vessel. The primary vessel moves such that at least one of the plurality of barges is positioned over a target or over the subsea structure adjacent to the well. The plurality of secondary vessels are connected by a plurality of mooring lines adjacent to an opposite end of the plurality of barges. These mooring lines are tensioned so as to fix a position of the opposite end of the plurality of barges. The deployment vessel is positioned away from the plurality of barges. An ROV is deployed from the deployment vessel. The ROV is manipulated so as to connect the subsea structure to the downline. The downline and the subsea structure are lifted toward the plurality of barges. The plurality of barges can then be moved such that the deployment vessel can retrieve the subsea structure.

Under certain circumstances there may be no blowing well and no plume from the blowing well. However, it is necessary to provide non-vertical installation or removal of a subsea structure because of an obstruction in the body of water. This obstruction would prevent the vertical installation of such equipment. As such, in the present invention, the end of the plurality of barges can be positioned by the primary vessel in a location generally above the target or subsea structure. The end of the plurality of barges will be away from the obstruction in the water. As such, the same steps, as described hereinabove, can be carried out so as to install or remove the subsea structure.

The foregoing disclosure and description of the invention is illustrative and explanatory thereof. Various changes in the details of the described process can be made within the scope of the present claims without departing from the true spirit of the invention. The present invention should be limited to the following claims and their legal equivalents.

We claim:

1. A process for installing or removing a subsea structure in a non-vertical manner at a well, the process comprising:
- securing a plurality of barges together in a linear formation in which one of the plurality of barges has a downline extending therefrom;
- connecting one end of the plurality of barges to a primary vessel;
- moving the primary vessel such that at least one of plurality of barges is positioned over a target at or adjacent to the well;
- connecting a plurality of secondary vessels by a plurality of mooring lines adjacent an opposite end of the plurality of barges;
- tensioning the plurality of mooring lines so as to fix a position of the opposite end of the plurality of barges;
- positioning a deployment vessel away from the plurality of barges;
- deploying an remotely-operated vehicle (ROV) from the deployment vessel;
- deploying the subsea structure from the deployment vessel;
- manipulating the ROV so as to connect the subsea structure to the downline; and
- moving the downline and the subsea structure toward or away from the well.

2. The process of claim 1, the well being a blowing well, the blowing well forming a plume at a water surface, the step of moving the primary vessel comprising:
- moving the primary vessel such that at least one of the plurality of barges is positioned within the plume.

3. The process of claim 2, the target being a wellhead of the blowing well, a blowout preventer at the blowing well, or a lower marine riser package at the blowing well.

4. The process of claim 3, further comprising:
- lowering the subsea structure from the deployment vessel toward the target; and
- moving the subsea structure with the ROV toward the downline.

5. The process of claim 4, the step of moving the downline comprising:
- lowering the downline and the subsea structure toward the target; and
- affixing the subsea structure to the wellhead or to the blowout preventer at the wellhead.

6. The process of claim 1, the subsea structure being positioned adjacent to the well, the process comprising:
- deploying the ROV such that the ROV moves downwardly toward the subsea structure;
- affixing the downline to the subsea structure with the ROV; and
- raising the subsea structure by paying in the downline from the plurality of barges.

7. The process claim 1, the step of tensioning comprising:
- moving the plurality of secondary vessels so as to triangulate the opposite end of the plurality of barges within the primary vessel and the plurality of secondary vessels.

8. The process of claim 7, the step of moving the plurality of secondary vessels comprises arranging the secondary vessels at an approximately 120° angle relative to the linear formation of the plurality of barges.

9. The process of claim 5, the subsea structure being a capping stack, the step of affixing the subsea structure comprising:
- affixing the capping stack to the blowout preventer.

10. The process of claim 2, the primary vessel and the plurality of secondary vessels residing outside the plume throughout the process.

11. The process of claim 1, the step of moving the primary vessel comprising:
- moving the primary vessel and the plurality of barges in a direction that is downwind.

12. The process of claim 1, each of the plurality of secondary vessels having a winch thereon, the step of tensioning comprising:
- actuating the winch so as to pay in the mooring lines such that the mooring lines of the plurality of secondary vessels are tensioned so that the opposite end of the plurality of barges is fixed in position over the well.

13. The process of claim 1, the deployment vessel being one of the primary vessel and the plurality of secondary vessels.

14. The process of claim 1, the step of moving the primary vessel comprising:
- moving the primary vessel and the plurality of secondary vessels such that the opposite end of the plurality of barges is located directly above the well.

15. The process of claim 4, further comprising:
- moving the subsea structure laterally into the plume with the ROV prior to the step of lowering.

16. The process of claim 15, further comprising:
- positioning the subsea structure above a mandrel of the blowout preventer;
- lowering the subsea structure on the blowout preventer; and
- locking the subsea structure on the mandrel of the blowout preventer.

17. The process of claim 16, further comprising:
- releasing the downline from the subsea structure after the subsea structure is affixed to the blowout preventer or the wellhead.

18. A process for installing a subsea structure in a non-vertical manner at a blowing well, the blowing well forming a plume of hydrocarbons at a water surface, the process comprising:
- securing a plurality of barges together in a linear formation in which one of the plurality of barges has a downline extending therefrom;
- connecting one end of the plurality of barges to a primary vessel;

moving the primary vessel toward the plume such that at least one of the plurality of barges is positioned within the plume;

connecting a plurality of secondary vessels by a plurality of mooring lines adjacent an opposite end of the plurality of barges;

tensioning the plurality of mooring lines so as to fix a position of the opposite end of the plurality of barges generally above the wellhead of the blowing well;

positioning a deployment vessel away from the periphery of the plume;

deploying a remotely-operated vehicle (ROV) from the deployment vessel:

lowering the subsea structure from the deployment vessel downwardly toward a seabed;

moving the subsea structure with the ROV toward the downline from the plurality of barges;

connecting the subsea structure to the downline;

moving the downline and the subsea structure toward the blowing well; and affixing the subsea structure to the wellhead or to a blowout preventer at the wellhead.

19. The process of claim 18, the step of tensioning comprising:

moving the plurality of secondary vessels so as to generally triangulate the opposite end of the plurality of barges within the primary vessel and the plurality of secondary vessels.

* * * * *